US006249917B1

(12) United States Patent
Vrissimdjis et al.

(10) Patent No.: US 6,249,917 B1
(45) Date of Patent: Jun. 26, 2001

(54) GLOVE OF RUBBER OR THE LIKE

(76) Inventors: Constantine Solon Vrissimdjis; Anastasia Ananiadou, both of 18, Papaflessa Street, Nea Erythrea 146 71, Attica (GR)

( * ) Notice: Subject to any disclaimer, the term of this patent is extended or adjusted under 35 U.S.C. 154(b) by 0 days.

(21) Appl. No.: 09/442,133

(22) Filed: Nov. 18, 1999

(30) Foreign Application Priority Data

Nov. 19, 1998 (GR) ..... 980100425

(51) Int. Cl.[7] ..... A41D 19/00

(52) U.S. Cl. ..... 2/161.7; 2/161.6; 2/168; 2/169

(58) Field of Search ..... 2/16, 125, 59, 2/161.1, 161.6, 159, 167, 169, 162, 168; 264/299, 301, 303, 318

(56) References Cited

U.S. PATENT DOCUMENTS 2,106,348 1/1938 Hall et al. .
2,821,718 2/1958 Hall et al. .
4,399,567 * 8/1983 Joong ..... 2/161
5,310,517 * 5/1994 Dams et al. ..... 264/255

FOREIGN PATENT DOCUMENTS 0 824 002 2/1998 (EP) .
2 030 450 11/1970 (FR) .
2 698 765 6/1994 (FR) .
508 981 1/1938 (GB) .

* cited by examiner

*Primary Examiner*—John J. Calvert
*Assistant Examiner*—Katherine Moran

(57) ABSTRACT

Glove of rubber or other resilient material comprising of an essentially tubular sleeve portion (1) and a cuff portion (2) which extends conically outwardly in extension of the sleeve portion and can be folded back such that the free end of the connically outwardly extending cuff portion (2) has a radial distance from the outer circumference of the sleeve portion (1), characterized in that a thinner wall portion (3) having a wall thickness smaller than the wall thickness of at least the sleeve portion (1) is provided between sleeve portion (1) and cuff portion (2), whereas the thinner wall portion (3) is either a thinner extension of the sleeve portion (1) or has the shape of an inwardly directed undulation, wherein the cuff portion (2) is foldable back about the said thinner wall portion (3).

12 Claims, 6 Drawing Sheets

GLOVE OF RUBBER OR THE LIKE

BACKGROUND OF THE INVENTION

The present invention relates to a glove of resilient material including an essentially tubular sleeve portion and a cuff portion which extends conically outwardly in extension of the sleeve portion and can be folded back so that a free end of the conically outwardly extending cuff portion has a radial distance from an outer circumference of the sleeve portion.

Such a glove is known from EP 0 824 002, wherein an inwardly directed undulation is provided between sleeve portion and cuff portion when the cuff portion extends in extension of the sleeve portion. A thickened wall portion is provided between undulation and cuff portion, whereas sleeve portion, undulation and cuff portion have the same wall thickness. When the cuff portion extends in extension of the sleeve portion certain stresses arise in the material of the glove wall in the area of the undulation which stresses are equalised as soon as the cuff portion is folded outwardly back about the undulation toward the sleeve portion.

It is an object of the present invention to provide a glove of the type mentioned in the introductory paragraph above in such a way that the material of the glove wall is essentially free of stresse condition that the cuff portion extends in extension of the sleeve portion, wherein a stable cuff portion is provided in the turned-back position which cuff portion maintains its shape and protective characteristic without collapsing or losing its firm position during movement of a hand wearing the glove.

SUMMARY OF THE INVENTION

According to principles of this invention, a sleeve of a glove has a thinner wall portion between a sleeve portion and a cuff portion, with the cuff portion being foldable back about the thinner wall portion.

This object is achieved by the features in the characterising part of claim 1.

Due to the thinner wall portion between sleeve portion and cuff portion no stresses arise in this area of the material, when the cuff portion extends in extension of the sleeve portion, whereas the cuff portion is foldable back about the thinner portion very easily and the cuff portion maintains its stable shape.

DESCRIPTION OF THE DRAWINGS

The invention is described in more detail by examples of embodiments of a glove in connection with the drawings.

DESCRIPTION OF THE INVENTION

Figure 1:
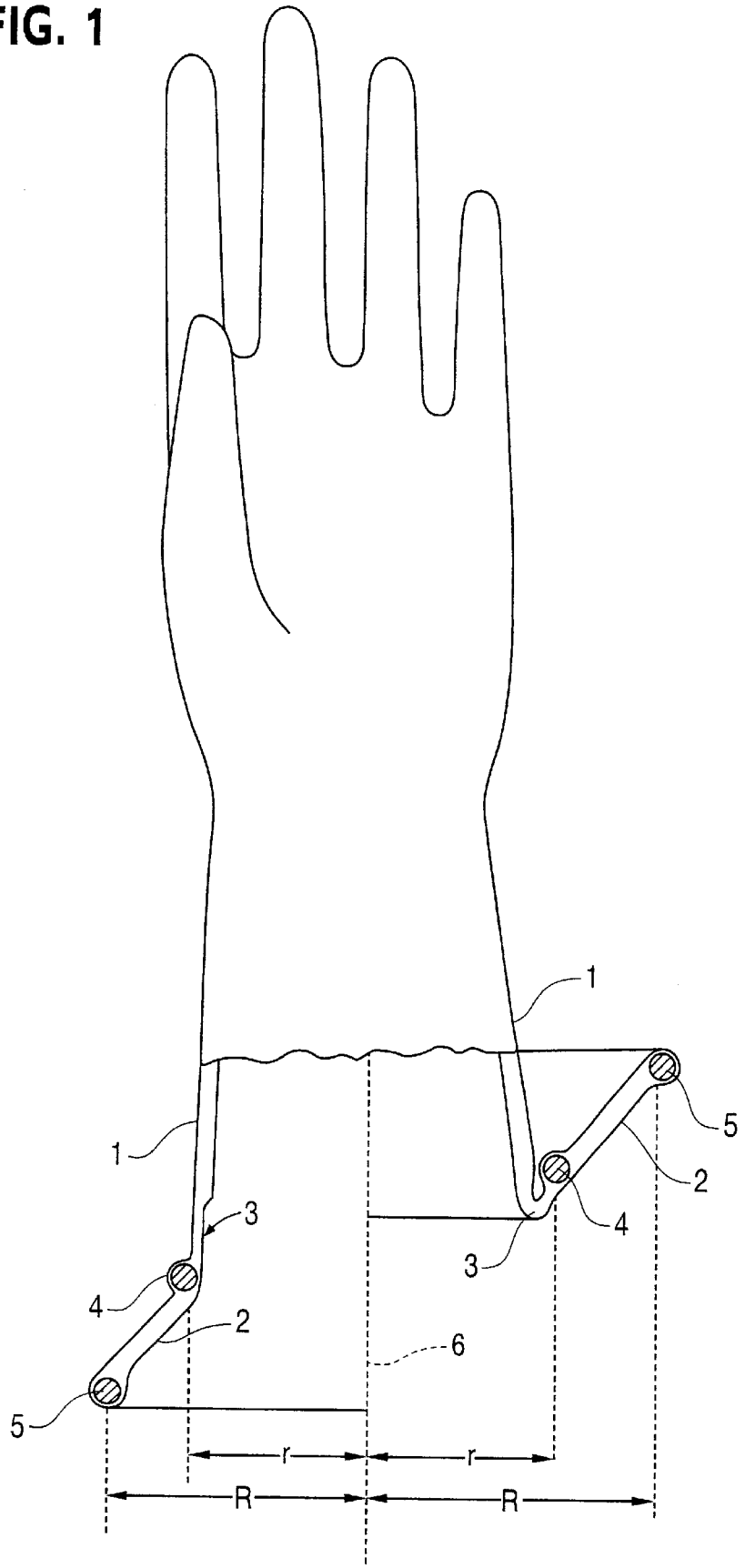
FIG. 1 shows schematically a partially cutway of this invention side view of a glove, wherein the end of the sleeve portion and the cuff portion are shown schematically in a longitudinal section and the left half of the section shows the cuff portion in extension of the sleeve portion, whereas the right half of the section shows the cuff portion in the folded-back position.

The figures show a glove of rubber, latex or another resilient material comprising an essentially tubular or slightly conical sleeve portion 1 and a cuff portion 2 which extends conically outwardly in extension of the sleeve portion 1 as shown in the left part of FIG. 1 for example. The cuff portion 2 has a wall thickness essentially equal to the wall thickness of the sleeve portion 1, whereas a thinner wall portion 3 is provided therebetween which thinner wall portion extends around the circumference of the glove. The cuff portion 2 can be folded outwardly back toward the sleeve portion 1 by bending the thinner wall portion 3 as shown in the right part of FIG. 1. Due to the thinner wall thickness on the wall portion 3 no or only low bending forces arise in this area if the cuff portion is in the position of the right part in FIG. 1.

In the embodiment according to FIG. 1 an annular bead or thickened wall portion 4 is provided between thinner wall portion 3 and cuff portion 2. Bead or thickened wall portion 4 means that this part is thicker than the wall thickness of the cuff portion 2. Such a bead 4 assists a stable shape of the folded back cuff portion. Depending on the length of the thinner wall portion 3 the bead or thickened wall portion 4 abuts in the folded back position on the outer circumference of the sleeve portion 1 as shown in FIG. 1 or—in case the thinner wall portion 3 has a greater length—on the outer circumference of the thinner wall portion 3, preferably in the transition area between thinner wall portion 3 and thicker sleeve portion 1 as it is the case in the embodiment according to FIG. 3.

The radius r of the annular bead 4 about the center axis 6 of the sleeve portion 1 in the position of the cuff portion 2 in the left part of FIG. 1 is essentially the same as in the folded back position of the cuff portion as shown in the right part of FIG. 1. In this way only bending forces arise in the thinner wall portion 3 when the cuff portion is folded back.

On the free end of the cuff portion 2 a further bead 5 is provided in the embodiment according to FIG. 1 as well in the other embodiments. Such a bead 5 assists a stable shape of the cuff portion 2 especially in the folded back position. The radius R of this annular bead 5 about the central axis 6 is preferably also equal in both positions of the cuff portion 2 as shown in FIG. 1.

If two beads 4 and 5 are provided on both ends of the cuff portion 2 then the wall thickness of the cuff portion 2 can be reduced without reduction of the stiffness of the cuff portion. In such a case the wall thickness of the cuff portion 2 can be smaller than the wall thickness of the sleeve portion 1.

Figure 2:
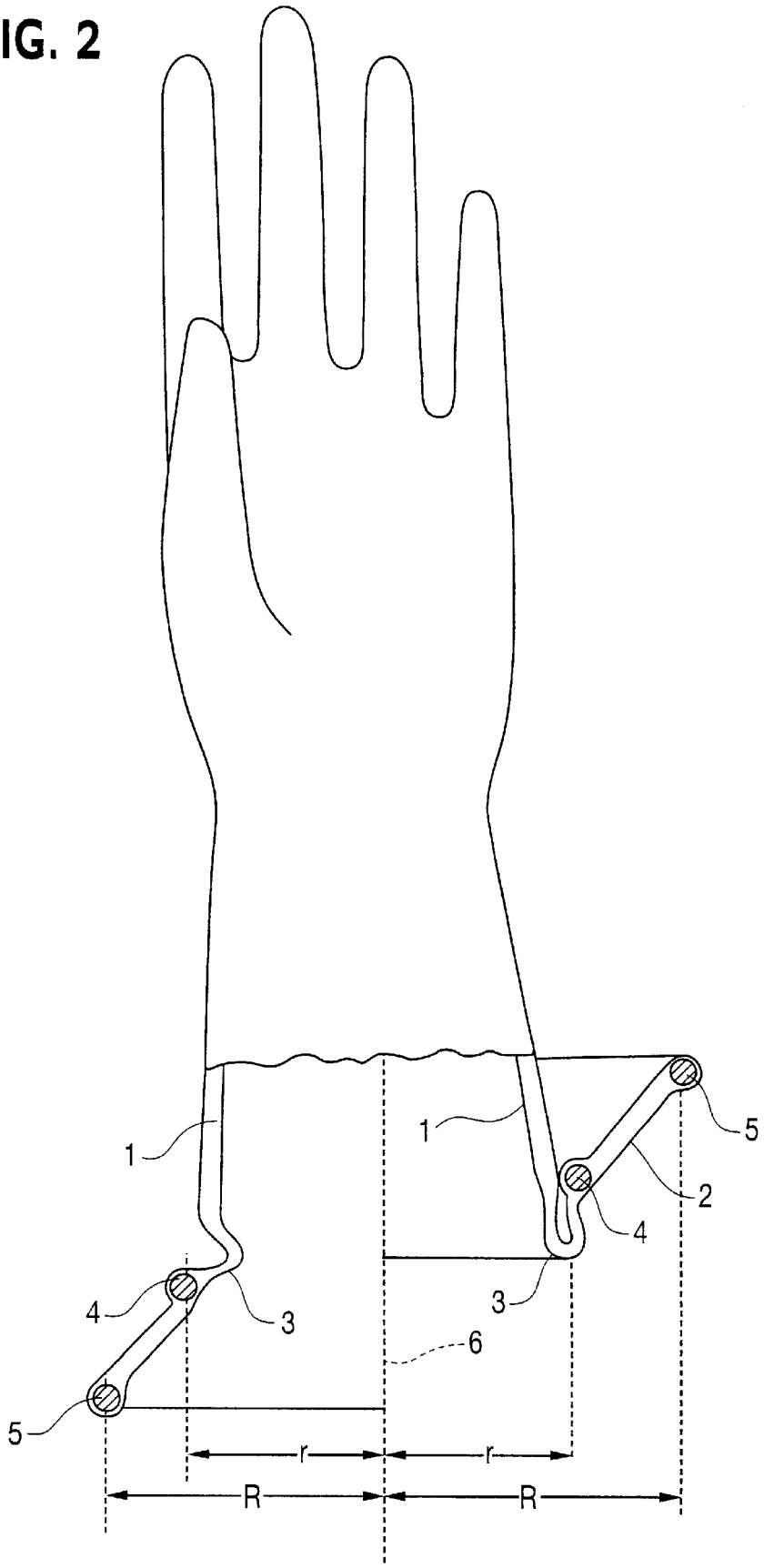
FIG. 2 shows a modified embodiment according to FIG. 1.

FIG. 2 shows a modified embodiment of the structure according to FIG. 1 in that the thinner wall portion 3 has the shape of an inwardly directed undulation when the cuff portion 2 extends in extension of the sleeve portion 1 as shown in the left part of FIG. 2. In this way the bending forces in the thinner wall portion 3 are reduced when the cuff portion is folded back toward the sleeve portion as shown in the right part of FIG. 2.

Figure 3:
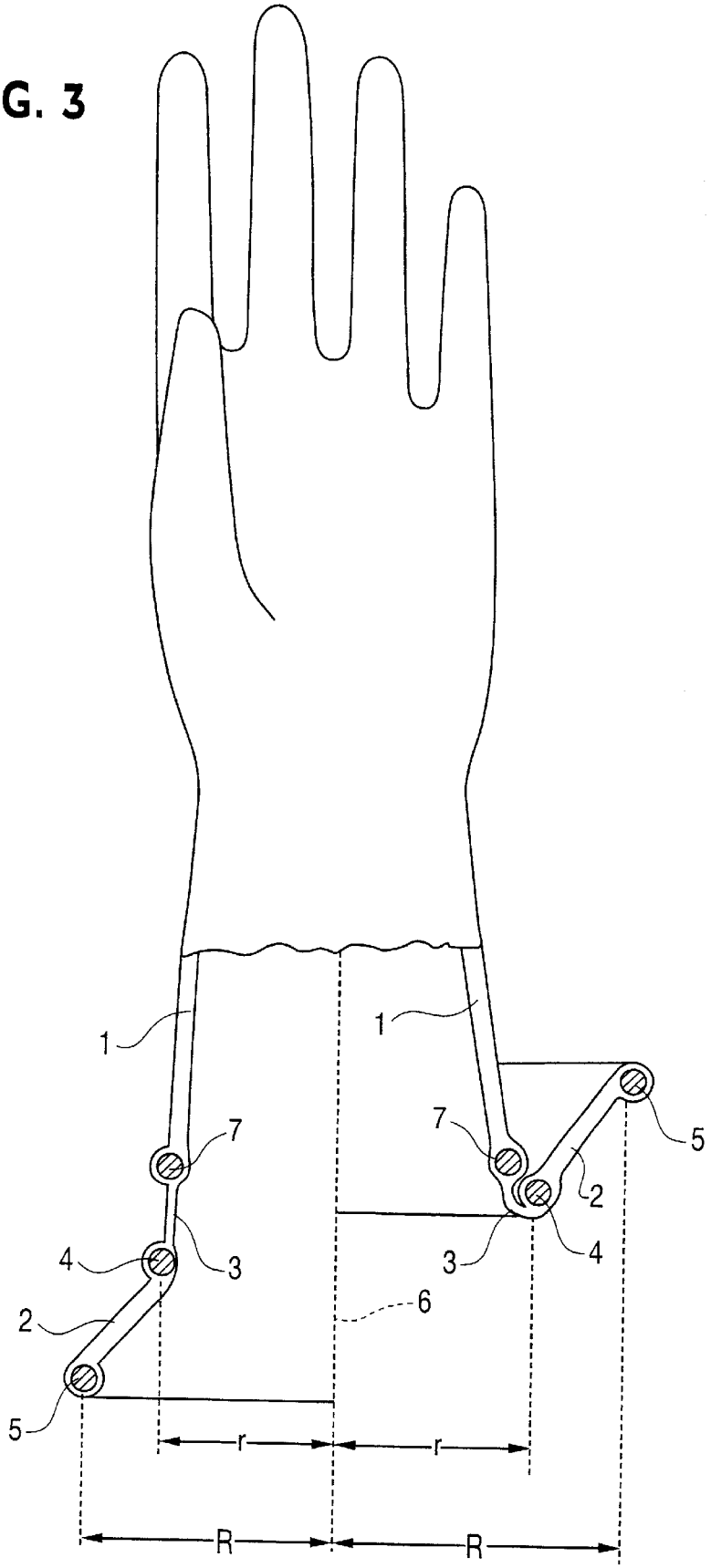
FIG. 3 shows another embodiment in the same way as in FIG. 1.

FIG. 3 shows another embodiment, wherein a second annular bead or thickened wall portion 7 is provided between thinner wall portion 3 and sleeve portion 1. In this embodiment the length of the thinner wall portion 3 can be dimensioned such that the first bead 4 abuts on the outer circumference of the thinner wall portion 3 in the folded back position of the cuff portion 2 as shown in the right part of FIG. 3 or the first bead 4 can abut on the outer circumference of the sleeve portion 1 in this position, i. e. on the other side of the second bead 7 as it is the case in the embodiment according to FIG. 5.

Figure 4:
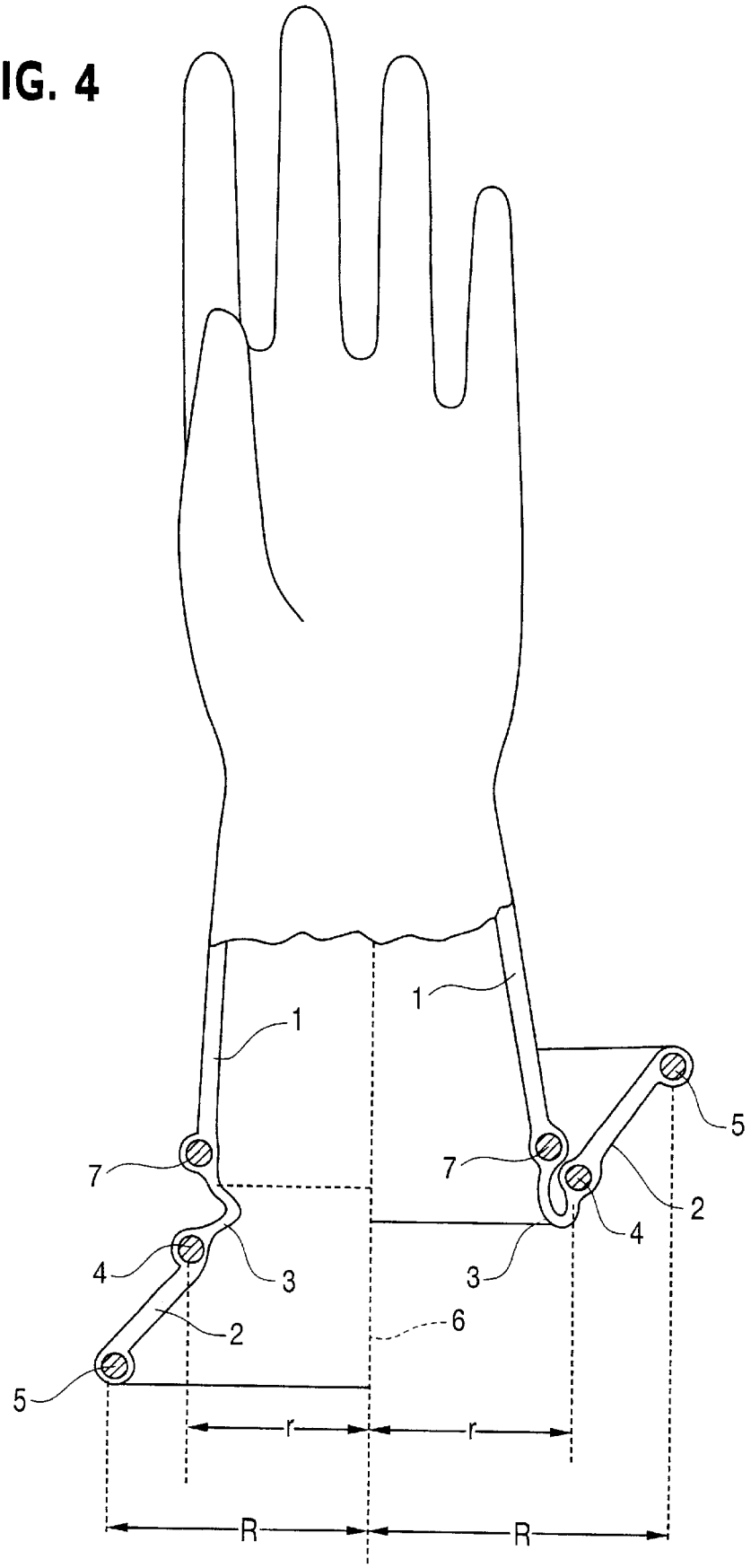
FIG. 4 shows a modified embodiment of the structure according to FIG. 3.

FIG. 4 shows a modified embodiment of the structure of FIG. 3 corresponding to the embodiment according to FIG. 2, wherein the thinner wall portion 3 has the shape of an inwardly directed undulation when the cuff portion 2 extends in extension of the sleeve portion 1 as shown in the left part of FIG. 4.

Figure 5:
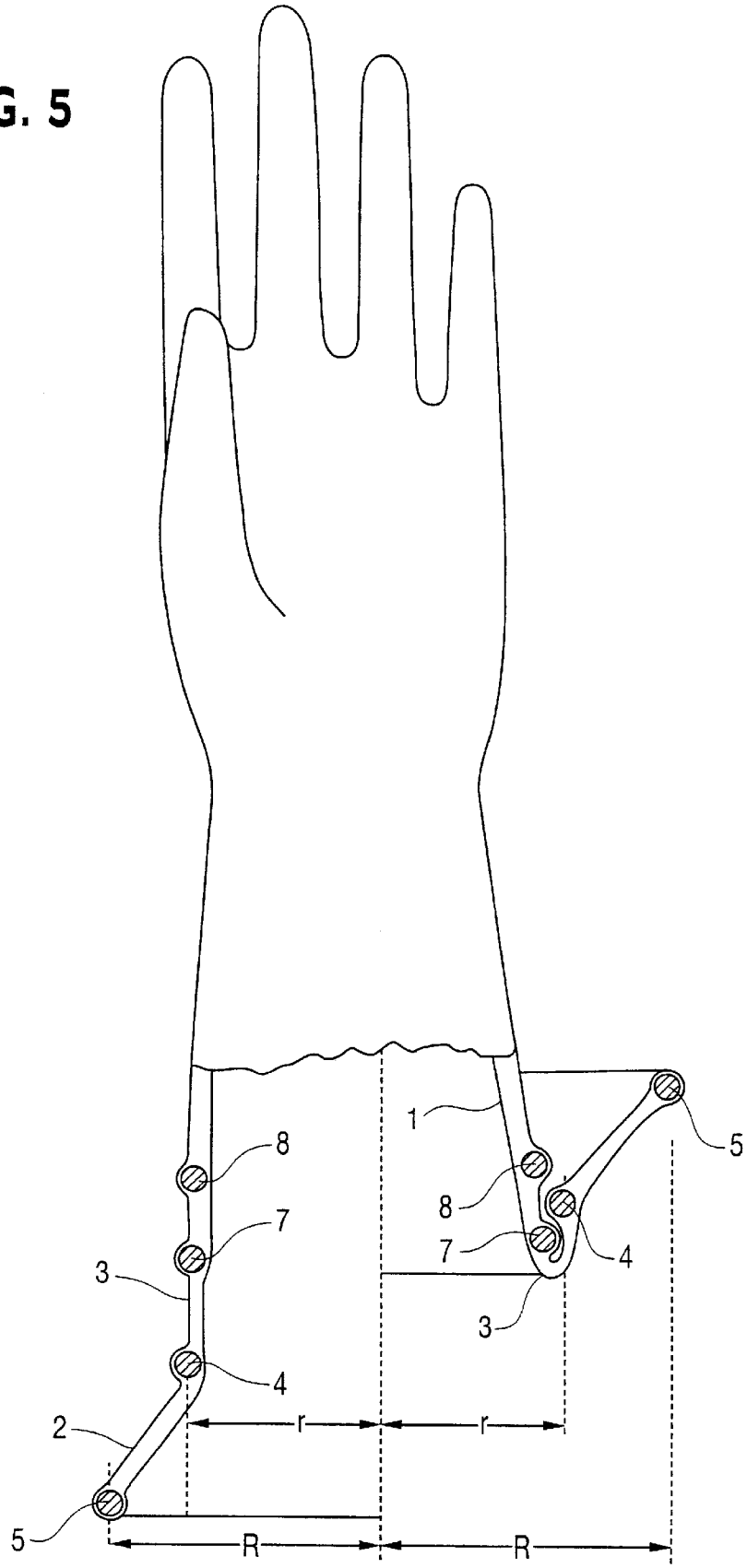
FIG. 5 shows a further embodiment in the same way as in FIGS. 1 and 3.

FIG. 5 shows a further embodiment comprising a third annular bead 8 which is arranged in a small distance from the second bead 7 on the sleeve portion 1. The length of the thinner wall portion 3 is dimensioned such that the first bead 4 engages between second bead 7 and third bead 8 in the folded back position as shown in the right part of FIG. 5. The distance between the two beads 7 and 8 preferably corresponds essentially to the longitudinal dimension of the bead or thickened wall portion 4.

The beads are shown as a solid ring of the glove material, but the shape of the cross section of the bead or thickened wall portion can be varied.

Also in case of the embodiment according to FIG. 5 the radius r and R of beads 4 and 5 are essentially the same in both positions of the cuff portion 2 to avoid stresses in the glove material.

Figure 6:
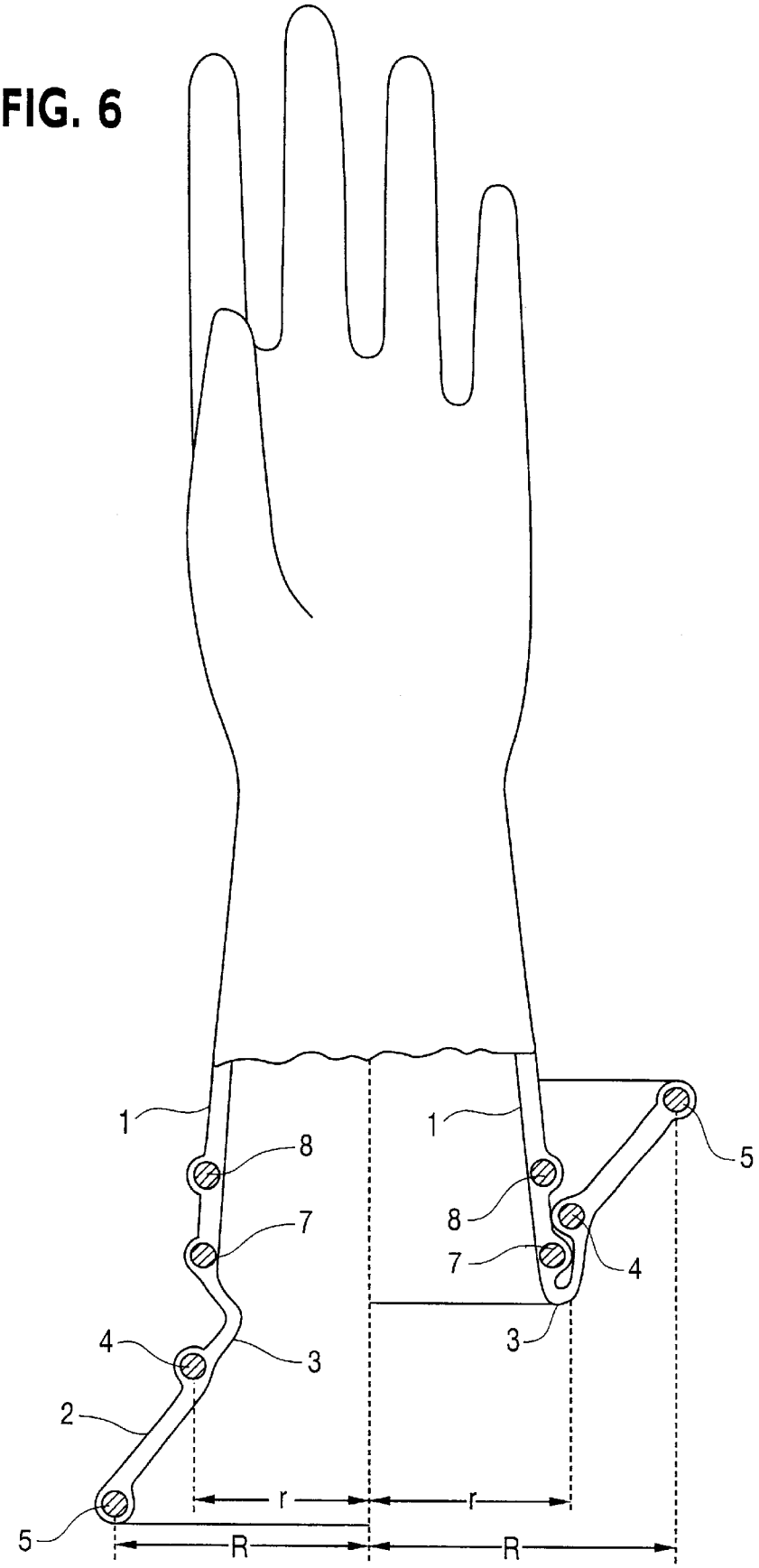
FIG. 6 shows a modified embodiment according to the structure in FIG. 5.

FIG. 6 shows a modified embodiment according to FIG. 5, wherein the thinner wall portion 3 has the shape of an inwardly directed undulation as it is described in connection with FIGS. 2 and 4.

The annular beads 7 and also 8 are provided for an additional reinforcement of the end portion of the sleeve portion 1 and additionally for receiving and positioning the bead 4 of the cuff portion.

What is claimed is:

1. Glove of a resilient material comprising a tubular sleeve portion (1) and a cuff portion (2) which extends conically outwardly in extension of the sleeve portion and can be folded back so that a free end of the conically outwardly extending cuff portion (2) has a radial-distance spacing from an outer circumference of the sleeve portion (1), wherein:

a thinner wall portion (3) having a wall thickness smaller than a wall thickness of at least the sleeve portion (1) is provided between sleeve portion (1) and cuff portion (2), and wherein the cuff portion (2) is foldable back about said thinner wall portion (3).

2. Glove according to claim 1, wherein a first annular bead (4) is provided between the thinner wall portion (3) and the cuff portion (2).

3. Glove according to claim 1, wherein a second annular bead (7) is provided between the thinner wall portion (3) and the sleeve portion (1).

4. Glove according to claim 3, wherein a third annular bead (8) is provided on the sleeve portion (1) at a distance from the second bead (7) so that the first bead (4) between the thinner wall portion (3) and the cuff portion (2) engages between the second and third annular beads on the outer circumference of the sleeve portion (1) when the cuff portion (2) is folded back about the thinner wall portion (3).

5. Glove according to claim 1, wherein the thinner wall portion (3) has the shape of an inwardly directed undulation when seen in a longitudinal section of the glove with the cuff portion (2) being in extension of the sleeve portion (1).

6. Glove according to claim 1, wherein the free end of the cuff portion (2) is provided with an annular bead (5).

7. Protecting sleeve of a resilient material comprising a tubular sleeve portion (1) and a cuff portion (2) which extends conically outwardly in extension of the sleeve portion and can be folded back so that the free end of the conically outwardly extending cuff portion (2) has a radial-distance spacing from an outer circumference of the sleeve portion (1), and wherein a transition area between sleeve portion (1) and cuff portion (2) is a thinner wall portion (3) having a wall thickness smaller than a wall thickness of at least the sleeve portion (1).

8. Glove according to claim 7, wherein a first annular bead (4) is provided between the thinner wall portion (3) and the cuff portion (2).

9. Glove according to claim 7, wherein a second annular bead (7) is provided between the thinner wall portion (3) and the sleeve portion (1).

10. Glove according to claim 9, wherein a third annular bead (8) is provided on the sleeve portion (1) at a distance from the second bead (7) so that the first bead (4) between the thinner wall portion (3) and the cuff portion (2) engages between the second and third annular beads on the outer circumference of the sleeve portion (1) when the cuff portion (2) is folded back about the thinner wall portion (3).

11. Glove according to claim 7, wherein the thinner wall portion (3) has the shape of an inwardly directed undulation when seen in a longitudinal section of the glove with the cuff portion (2) being in extension of the sleeve portion (1).

12. Glove according to claim 7, wherein the free end of the cuff portion(2) is provided with an annular bead (5).

* * * * *